United States Patent [19]

Tagawa et al.

[11] 4,324,483

[45] Apr. 13, 1982

[54] MAGNETIC BRUSH DEVELOPMENT APPARATUS

[75] Inventors: Kazuaki Tagawa, Tokyo; Minoru Suzuki, Yokohama; Makoto Hashimoto, Kawasaki, all of Japan

[73] Assignee: Ricoh Company, Ltd., Tokyo, Japan

[21] Appl. No.: 179,646

[22] Filed: Aug. 20, 1980

[30] Foreign Application Priority Data

| | | | |
|---|---|---|---|
| Aug. 21, 1979 | [JP] | Japan | 54-106169 |
| Sep. 4, 1979 | [JP] | Japan | 54-113262 |
| Sep. 4, 1979 | [JP] | Japan | 54-113263 |

[51] Int. Cl.[3] ..... G03G 15/00; G03G 15/09

[52] U.S. Cl. ..... 355/3 DD; 118/657; 118/658

[58] Field of Search ..... 355/3 DD, 14 D, 3 R, 355/14 R, 15; 118/657, 658, 639; 430/122

[56] References Cited

U.S. PATENT DOCUMENTS

| | | | |
|---|---|---|---|
| 3,982,498 | 9/1976 | Wilcox | 355/3 DD X |
| 4,034,709 | 7/1977 | Fraser et al. | 118/658 |
| 4,048,958 | 9/1977 | Nakaguchi et al. | 118/658 |
| 4,173,294 | 11/1979 | Savage | 355/3 DD X |
| 4,177,757 | 12/1979 | Murakawa et al. | 118/658 |
| 4,226,524 | 10/1980 | Hashimoto | 118/657 X |

*Primary Examiner*—Arthur C. Prescott

*Attorney, Agent, or Firm*—Wyatt, Gerber, Shoup, Scobey & Badie

[57] ABSTRACT

A magnetic brush development apparatus of the type comprising a plurality of rotatable, non-magnetic sleeves having stationary, inner magnets and capable of successively scooping up developer to the development section by the sleeves, wherein the magnets in the adjacent sleeves, located in the region where the developer is transferred from one sleeve to the next sleeve, are the same in polarity.

5 Claims, 4 Drawing Figures

MAGNETIC BRUSH DEVELOPMENT APPARATUS

BACKGROUND OF THE INVENTION

The present invention relates to a magnetic brush development apparatus for use in electrophotographic copying machines, electrostatic recording apparatus or the like.

In a magnetic brush development apparatus, magnetic developer is attracted to a non-magnetic cylindrical sleeve having inner magnets, to form a magnetic brush on the surface of the non-magnetic sleeve, and either the non-magnetic sleeve or the inner magnets are rotated, so as to transport the magnet brush formed on the sleeve to a development area where the magnet brush is brought into contact with a latent electrostatic image formed on a latent electrostatic image bearing member, for development of the latent electrostatic image. Usually, the magnetic brush is transported by rotating the non-magnetic sleeve, while the magnets are fixed. As the developer for use in magnetic brush development, a two-component type developer comprising magnetic carrier and toner, or a one-component type developer consisting of magnetic toner, is employed.

In such magnetic brush development apparatus, it is preferable that development be performed while mixing the developer sufficiently so as to be in a loose state. In order to attain this, at least two rotatable, non-magnetic sleeve having inner magnets are employed by disposing one over the other, whereby the developer particles are sufficiently mixed and dispersed when the developer is scooped up by the lower non-magnetic sleeve and delivered to the upper non-magnetic sleeve. In a magnetic brush development apparatus of the above-mentioned type, the magnets within the two sleeves located in the area where the developer is transferred from one sleeve to the other sleeve are usually opposite in polarity. According to experiments conducted by the inventors of the present invention, in the above-mentioned type magnetic brush development apparatus, with the magnets arranged in the above-mentioned manner, when the two sleeves are rotated at a comparatively low speed, the developer can be sufficiently transferred from the lower sleeve to the upper sleeve. However, as the rotation speeds of the two sleeves are increased for high speed development, the performance of developer transportation from the lower sleeve to the upper sleeve decreases. The result is that the developer deposited on the lower sleeve is not transported to the upper sleeve, but remains on the lower sleeve, bringing about an insufficient supply of the developer for development, reduction of image density and non-uniform development of images.

The above-mentioned phenomenon may take place for the following reason: In the above-mentioned type magnetic brush development apparatus, once the developer is deposited on the lower sleeve, the developer is comparatively strongly attracted to the lower sleeve, since the magnet in the lower sleeve and that in the upper sleeve in the developer transition region are opposite in polarity to each other. However, when the two sleeves are rotated at a high speed, the developer deposited on the lower sleeve can stay there, but readily it could not happen that the developer is detached from the lower sleeve and clings to the surface of the upper sleeve which is rotated at a high speed.

SUMMARY OF THE INVENTION

According to the invention, there is provided a magnetic brush development apparatus comprising a rotatable, non-magnetic sleeve for development having stationary, inner magnets therein, and at least one rotatable, nonmagnetic sleeve having similar stationary, inner magnets therein, for supplying developer to the first above-mentioned rotatable, non-magnetic development sleeve, wherein the magnets in those sleeves, located in a developer transition region where the developer is transferred from the developer supplier sleeve to the development sleeve, are of the same polarity.

In a preferred embodiment of the invention, the magnetic poles of the magnets in the developer transition region are positioned in such a manner that the magnetic force for attracting the developer is stronger on the developer receiving side than on the developer supplying side.

In such a magnetic brush development apparatus, even if those rotatable, non-magnetic sleeves are rotated at a high speed, a sufficient amount of the developer can be transferred between them. Further, since the magnets disposed within those sleeves located in the developer transition region are of the same polarity, those magnets do not work as a brake on the rotatable sleeves. Therefore, the drive torque necessary for the sleeves can be reduced.

It is therefore an object of the invention to provide an improved magnetic brush development apparatus comprising a plurality of cylindrical rotatable members having stationary magnets therein and capable of transferring developer between those cylindrical, rotatable members.

Another object of the invention is to provide a magnetic brush development apparatus of the above-mentioned type, wherein the magnets in the sleeves located in the developer transition region are of the same polarity, in order that a sufficient amount of the developer can be transferred between the sleeves even if the sleeves are rotated at high speeds.

A further object of the invention is to provide a magnetic brush development apparatus of the above-mentioned type, wherein the positions of the magnetic poles of the magnets are such that they are capable of transferring the developer sufficiently between the sleeves.

These and other objects will become more apparent from the following description and drawings.

DETAILED DESCRIPTION OF THE PREFERRED EMBODIMENTS

Figure 1:
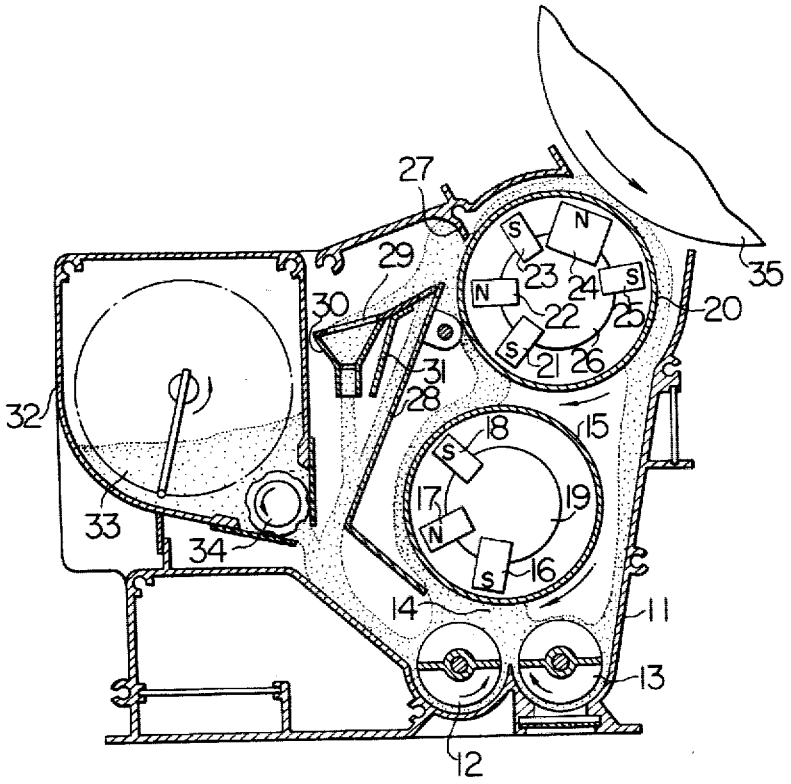
FIG. 1 is a schematic cross section of an embodiment of a magnetic brush development apparatus according to the invention.

Referring to FIG. 1, there is schematically shown an embodiment of a magnetic brush development apparatus according to the invention. In FIG. 1, in an inner bottom portion of a developer reservoir 11, two concave portions are formed. In those two concave portions, there are disposed a pair of stirrer shafts 12, 13 in such a manner as to be rotatable. The stirrer shafts 12, 13 are formed in the shape of a clockwise-twisted strip. The stirrer shafts 12 is rotated counter-clockwise, so that a developer 14 comprising carrier and toner, held in the developer reservoir 11, is transported from the front side to the back side of the developer reservoir 11, while the strirr shaft 13 is rotated clockwise, so that the developer 14 is transported from the back side to the front side of the developer reservoir 11. By the rotations of the stirrer shafts 12, 13 in the opposite directions, the developer 14 is circulated along the two shafts 12, 13 and stirred sufficiently during the circulation. Above the stirrer shafts 12, 13, there is situated a non-magnetic sleeve 15 for supplying developer in such a manner as to be located parallel to the two stirrer shafts 12, 13 and also to be rotatable clockwise. Within the developer supplier sleeve 15, there is disposed a stationary shaft 19 to which magnets 16, 17 and 18 are attached in such a manner as to be directed radially from the shaft 19. Above the developer supplier sleeve 15, there is situated a non-magnetic development sleeve 20 for developing latent electrostatic images, which is also rotatable clockwise and in which a stationary shaft 26 is disposed. Magnets 21, 22, 23, 24 and 25 are attached to the stationary shaft 26 in such a manner as to be directed radially from the shaft 26. The polarity of the magnet 18 is the same as that of the magnet 21. From the inner wall of the developer reservoir 11, a projection 27 extends in close proximity to a portion of the surface of the sleeve 20 between the magnet 22 and the magnet 26. The projection 27 serves as a doctor for controlling the amount of the developer 14 deposited on the sleeve 20. Under the doctor 27, there is disposed a division plate 28 which extends from above the sleeve 20 to over the sleeve 15. From the upper end of the division plate 28, a downwardly inclined developer flow plate 39 extends, and at the end of the developer flow plate 39, there is disposed a hopper 30 in which a toner concentration detection apparatus is incorporated. In FIG. 1, reference numeral 31 represents a magnetic shield plate for preventing noise when detecting the toner concentration. When development is performed by use of a two-component type developer, the developer is stirred so that the magnetic carrier and resinous toner in the developer are brought into contact with each other, and the toner is triboelectrically charged to a polarity opposite to that of the carrier and to that of a latent electrostatic image to be developed, and the toner particles are deposited on the latent electrostatic image, whereby development of the electrostatic image is accomplished. Therefore, each time a copy is made, some toner is used for imaging and thus depleted from the supply. Therefore, in accordance with the detection of toner concentration, quantities of toner are added to the developer to replace that which has been used. The stirring of the developer is is not only for charging the toner triboelectrically, but also for mixing the toner and carrier uniformly, preventing the toner concentration from becoming non-uniform in the developer. If the toner concentration in the developer is non-uniform, the image density of images developed will also become non-uniform.

The developer 14, stirred by the stirrer shafts 12, 13, is attracted to the developer supplier sleeve 15 by the magnet 16 disposed inside the sleeve 15. The developer 14 is then delivered upward as the developer supplier sleeve 15 is rotated. The developer 14 is transported from the area of the sleeve 15 over the magnets 17, 18 onto the development sleeve 20, and is then delivered upwards by the rotation of the sleeve 20. The developer 14 which has been transferred onto the development sleeve 20 is brought to the doctor 27, where the amount of the developer to remain on the development sleeve 20 is controlled appropriately as the sleeve 20 is rotated. Part of the excess developer which has been scraped off the development sleeve 20 by the doctor 27 flows down along the division plate 28 and returns to the stirrer shaft 12, where the developer is stirred again and is then attracted to the developer supplier sleeve 15. The other part of the excess developer which has been scraped off the development sleeve 20 by the doctor 27 flows down along the developer flow plate 29 and enters the hopper 30, where the toner concentration is detected. In accordance with the toner concentration detected, if necessary, toner 33 held in a toner tank 32 is scooped up by a scoop roller 34 and supplied to the stirrer shaft 12. The developer which is not scraped off by the doctor 27 is used for development of a latent electrostatic image formed on the surface of a photoconductor drum 35 and is then caused to flow along a portion of the development sleeve 20 behind which no magnet is disposed, along the side wall of the developer reservoir 11 onto the stirrer shaft 13. The developer that is returned to the stirrer shaft 13 is again attracted to the developer supplier sleeve 15.

Figure 2:
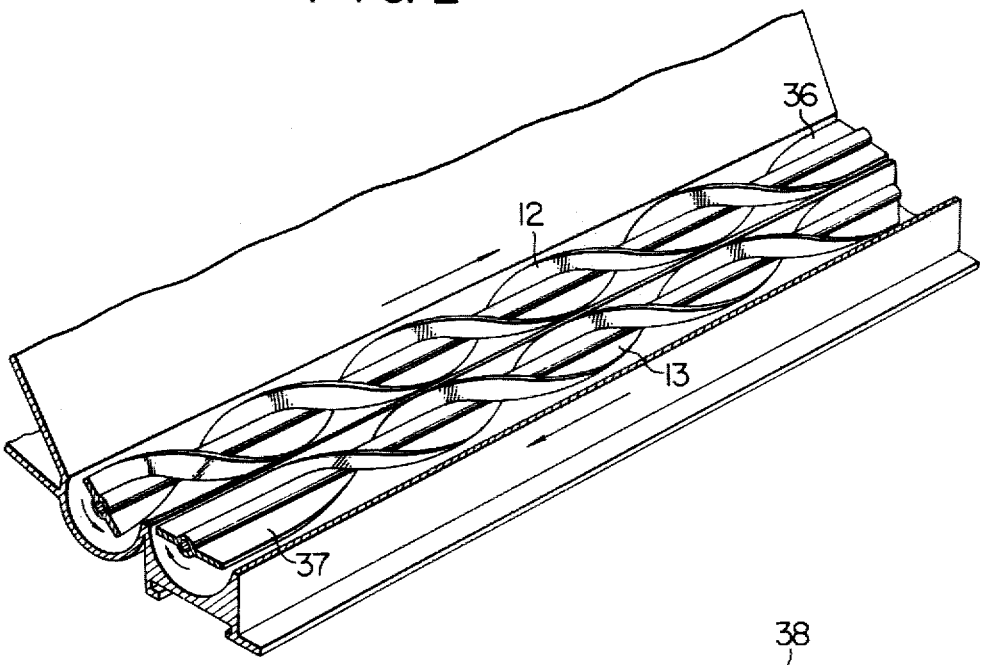
FIG. 2 is a perspective view of stirrer shafts which can be employed in the invention.
Figure 3:
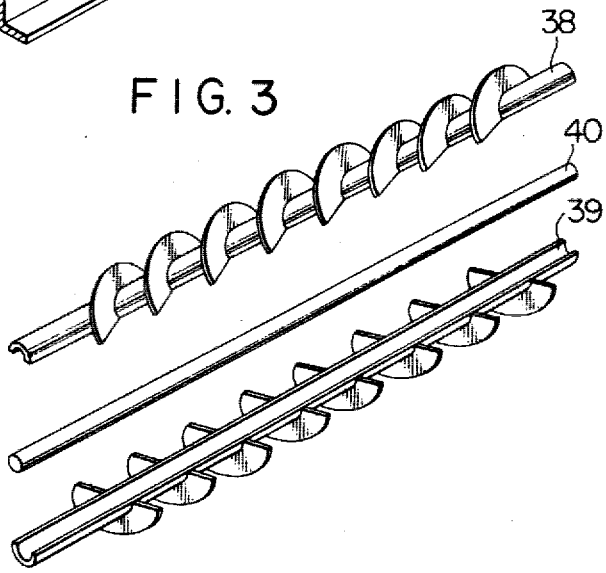
FIG. 3 is a perspective, disassembled view of another stirrer shaft which can be employed in the invention.

As mentioned previously, the stirring of the developer 14 by the stirrer shafts 12, 13 is performed by transferring the developer along the stirrer shaft 12 in one direction and along the stirrer shaft 13 in the opposite direction. Therefore, the developer that has been scraped by the doctor and accordingly that has not been used for development, and the developer that has passed under the doctor 27 and accordingly that has made a contribution to development of the latent electrostatic image on the photoconductor drum 35, are all mixed and stirred by the stirrer shafts 12, 13. Circulation of the developer 14 can be done more effectively by forming paddle portions 36, 37 at the downstream ends of the stirrer shafts 12, 13, respectively, as shown in FIG. 2. Instead of the twisted-strip type stirrer shafts 12, 13, a stirrer comprising two long stirring members 38, 39, with semi-elliptic blades attached therealong, each of which in cross section is semi-circular, directed in the opposite directions, respectively, and a shaft 40 for supporting the two members 38, 39, so as to be covered by the two members 38, 39, or coil spring member having coil spring portions at predetermined intervals, or an ordinary impeller, if the stirring of the developer in its axial direction is not expected, can be employed.

As shown in FIG. 1, in the invention, since the magnet 18 in the developer supplier sleeve 15 and magnet 21 in the development sleeve 20, which are located in the developer transition portion from the developer supplier sleeve 15 to the development sleeve 20, are of the same polarity, the main forces applied to the developer located in that portion are in the centrifugal forces of the sleeves 15, 20 and the gravity of the developer itself present in that portion, and the magnetic force for attracting the developer to the developer supplier sleeve 15 does not work. Therefore, the developer present in that area of the sleeve 15 is in a loose state and can be readily transferred from the sleeve 15 to the sleeve 20. Thus, unlike the case where the magnet in one sleeve is opposite in polarity to the magnet in the other sleeve, in the developer transition portion between the two sleeves in the development apparatus according to the invention, those magnets do not work as a brake when the two sleeves are rotated. Therefore, the drive torque necessary for rotating the two sleeves can be reduced.

In the above-mentioned embodiment, the magnets in the sleeve 15 and the magnets in the sleeve 20 are disposed around the shaft 19 and shaft 26, respectively, and are in the shape of blocks. However, instead of such magnets, roll-shaped magnets 41, 42 as shown in FIG. 4, whose peripheral surfaces are locally magnetized in predetermined portions thereof, capable of applying substantially the same magnetic forces to the developer as those of the magnets in the above-mentioned embodiment, can be employed.

Figure 4:
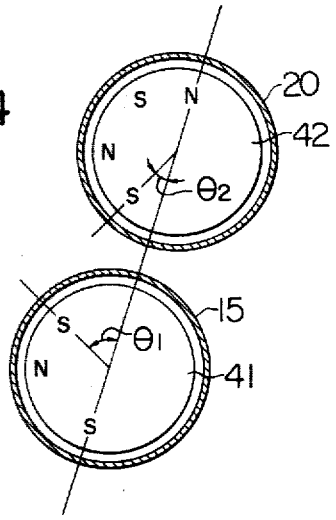
FIG. 4 is a schematic cross section of the main portion of another embodiment of a magnetic brush development apparatus according to the invention.

Referring to FIG. 4 supposing that the angle formed by the line connecting the centers of the sleeve 15, 20 and the magnetic pole line of the magnet in the sleeve 15 which makes a direct contribution to the transfer of the developer from the sleeve 15 to the sleeve 20 is $\theta_1$, and the angle formed by the same line connecting the centers of the sleeves 15, 20 and the magnetic pole line of the magnet in the sleeve 20 which makes a similar contribution to the transfer of the developer from the sleeve 15 to the sleeve 20 is $\theta_2$, when $\theta_1 > \theta_2$, since the attractive force of the magnet in the sleeve 20 is greater than that of the magnet in the sleeve 15, transfer of the developer from the sleeve 15 to the sleeve 20 can be readily accomplished.

Furthermore, in the above-mentioned embodiment, the two sleeves, the developer supplier roller 15 and the development roller 20, are employed. However, the invention is applicable to a development apparatus in which more developer supplier rollers are employed. Further, in the invention, instead of the sleeves 15, 20, endless belt-formed rotating members can also be used.

Conventionally, in the case of a toner concentration detection apparatus disposed in a development apparatus, it is considered best to measure the toner concentration after the developer has been used for development. Therefore, a conventional toner concentration detection apparatus is disposed in such a position as to be capable of receiving the developer that has been scraped from the photoconductor after development or in a developer mixing portion. However, if the toner concentration detectiong apparatus is disposed in such a position, when an irregularly large amount of toner in the developer has been used and the toner concentration in the developer has decreased locally, for instance, by developing comparatively large, solid latent electrostatic images, the toner concentration detection apparatus erroneously detects that the overall toner concentration of the developer is low. As a result, excess toner is supplied, making the toner concentration higher than the predetermined level. Therefore, accurate detection of the toner concentration cannot be performed when the toner concentration detection apparatus is located in the conventional position. In contrast to this, in the magnetic brush development apparatus according to the invention, the toner concentration is measured with respect to part of the developer that has been scraped immediately before the other portion of the developer is used for development. The developer deposited on the development sleeve immediately before it is used for development is uniform in distribution of toner and therefore accurate measurement of the toner concentration can be accomplished in such area. For measurement of the toner concentration, various types of conventional toner concentration apparatuses can be employed, such as an apparatus of the type measuring the change in inductance by causing the developer to pass through a coil; an apparatus of the type depositing toner on an electrode plate and photoelectrically detecting the amount of toner deposited on the electrode plate; or an apparatus of the type of detecting the reflectance of the developer directly. In the above-mentioned embodiment, the developer for use in measurement of the toner concentration is scraped from the development sleeve 20 by the doctor 207, but any other scraping means can be employed.

Furthermore, in the embodiment of a magnetic brush development apparatus according to the invention, the developer which has been scraped by the doctor 27 and the developer which has not been scraped and has made a contribution to development are caused to pass through two different circulation paths, and in each circulation path a developer stirrer is disposed. Therefore, the developer can be stirred sufficiently, making the toner concentration in the developer uniform. Furthermore, those stirrers each transfer the developer in opposite directions along their axes for more efficient stirring of the developer.

While the invention has been described in conjunction with specific embodiments, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a magnetic brush development apparatus comprising a rotatable, non-magnetic sleeve for development having stationary, inner magnets therein, and at least one rotatable, non-magnetic sleeve having similar stationary, inner magnets therein, for supplying developer to said first rotatable, non-magnetic development sleeve, the improvement wherein said magnets in the sleeves located in a developer transition region where the developer is transferred from the developer supplier sleeve to the development sleeve are of the same polarity.

2. A magnetic brush development apparatus as in claim 1 wherein the magnetic poles of said magnets in the developer transition region are positioned in such a manner that the magnetic forces for attracting the developer are stronger on the developer receiving side than on the developer supplying side.

3. A magnetic brush development apparatus as in claim 1, wherein said magnets each are in the shape of blocks.

4. A magnetic brush development apparatus as in claim 1, wherein said magnets are in the shape of a roller.

5. A magnetic brush development apparatus as in claim 1, wherein said apparatus is adapted to use developer of a two-component type comprising toner and magnetic carrier.

* * * * *